US011085710B2

(12) United States Patent
Heusser

(10) Patent No.: US 11,085,710 B2
(45) Date of Patent: Aug. 10, 2021

(54) HEAT EXCHANGER

(71) Applicant: Promix Solutions AG, Winterthur (CH)

(72) Inventor: Rolf Heusser, Winterthur (CH)

(73) Assignee: PROMIX SOLUTIONS AG, Winterthur (CH)

( * ) Notice: Subject to any disclaimer, the term of this patent is extended or adjusted under 35 U.S.C. 154(b) by 206 days.

(21) Appl. No.: 16/149,934

(22) Filed: Oct. 2, 2018

(65) Prior Publication Data

US 2019/0162490 A1 May 30, 2019

(30) Foreign Application Priority Data

Nov. 28, 2017 (EP) ..... 17204212

(51) Int. Cl.

| | |
|---|---|
| ***F28F 13/12*** | (2006.01) |
| ***F28D 7/00*** | (2006.01) |
| ***B01F 5/06*** | (2006.01) |
| ***F28F 1/00*** | (2006.01) |
| ***B01F 15/06*** | (2006.01) |

(Continued)

(52) U.S. Cl.

CPC ..... *F28F 13/12* (2013.01); *B01F 3/10* (2013.01); *B01F 5/061* (2013.01); *B01F 15/066* (2013.01); *F28D 7/0058* (2013.01); *F28F 1/003* (2013.01); *B01F 2005/0631* (2013.01); *B01F 2005/0639* (2013.01); *F28D 2021/0052* (2013.01); *F28F 2210/10* (2013.01)

(58) Field of Classification Search

CPC ..... F28F 1/003; F28F 13/12; F28F 2210/10; F28D 7/0058; F28D 2021/0052; B01F 5/061; B01F 5/066; B01F 2005/0631; B01F 2005/0639; B01F 3/10

See application file for complete search history.

(56) References Cited

U.S. PATENT DOCUMENTS 1,528,859 A * 3/1925 Taylor ..... F28D 7/0058 138/38
4,685,514 A * 8/1987 Brown ..... F28F 13/12 138/38

(Continued)

FOREIGN PATENT DOCUMENTS

DE 68905806 T2 11/1993
EP 0646408 A1 4/1995

(Continued)

*Primary Examiner* — Jon T. Schermerhorn, Jr.
(74) *Attorney, Agent, or Firm* — Hard IP LLC

(57) ABSTRACT

The heat exchanger (1) contains a jacket element (2) and an insert element (3), wherein the insert element (3) is arranged in the operating state in the interior of the jacket element (2). The insert element has a longitudinal axis (4). The insert element (3) contains an insert jacket element (31) and a plurality of web elements (9, 10), the web elements (9, 10) having a first end (13) and a second end (14). The first end (13) and the second end (14) of each web element (9, 10) are connected to the insert jacket element (31) at different locations. At least a portion of the web elements (9, 10) includes web element channels (11, 12), the web element channels (11, 12) extending from the first end (13) of the web element (11) to the second end (14) of the web element (11). An intermediate jacket element (5) is arranged between the insert jacket element (31) and the jacket element (2).

13 Claims, 4 Drawing Sheets

(51) Int. Cl.
*B01F 3/10* (2006.01)
*F28D 21/00* (2006.01)

(56) References Cited

U.S. PATENT DOCUMENTS

| | | | | | |
|---|---|---|---|---|---|
| 4,692,030 | A * | 9/1987 | Tauscher | B01F 5/061 | 366/337 |
| 4,865,460 | A * | 9/1989 | Friedrich | B01F 5/061 | 366/337 |
| 6,394,644 | B1 * | 5/2002 | Streiff | B01F 5/0617 | 366/337 |
| 2001/0012235 | A1 * | 8/2001 | Schuchardt | F28D 7/0058 | 366/337 |
| 2004/0251006 | A1 * | 12/2004 | Marin | F28F 1/36 | 165/157 |
| 2011/0185714 | A1 * | 8/2011 | Lohbreyer | F28F 9/26 | 60/320 |
| 2015/0083375 | A1 * | 3/2015 | Heusser | F28D 7/0058 | 165/109.1 |

FOREIGN PATENT DOCUMENTS

| | | | |
|---|---|---|---|
| EP | 0967004 | A1 | 12/1999 |
| EP | 1123730 | A2 | 8/2001 |
| EP | 1384502 | A1 | 1/2004 |
| EP | 2851118 | B1 | 5/2016 |
| WO | 8202004 | A1 | 6/1982 |

* cited by examiner

A-A

C-C

Fig. 4a
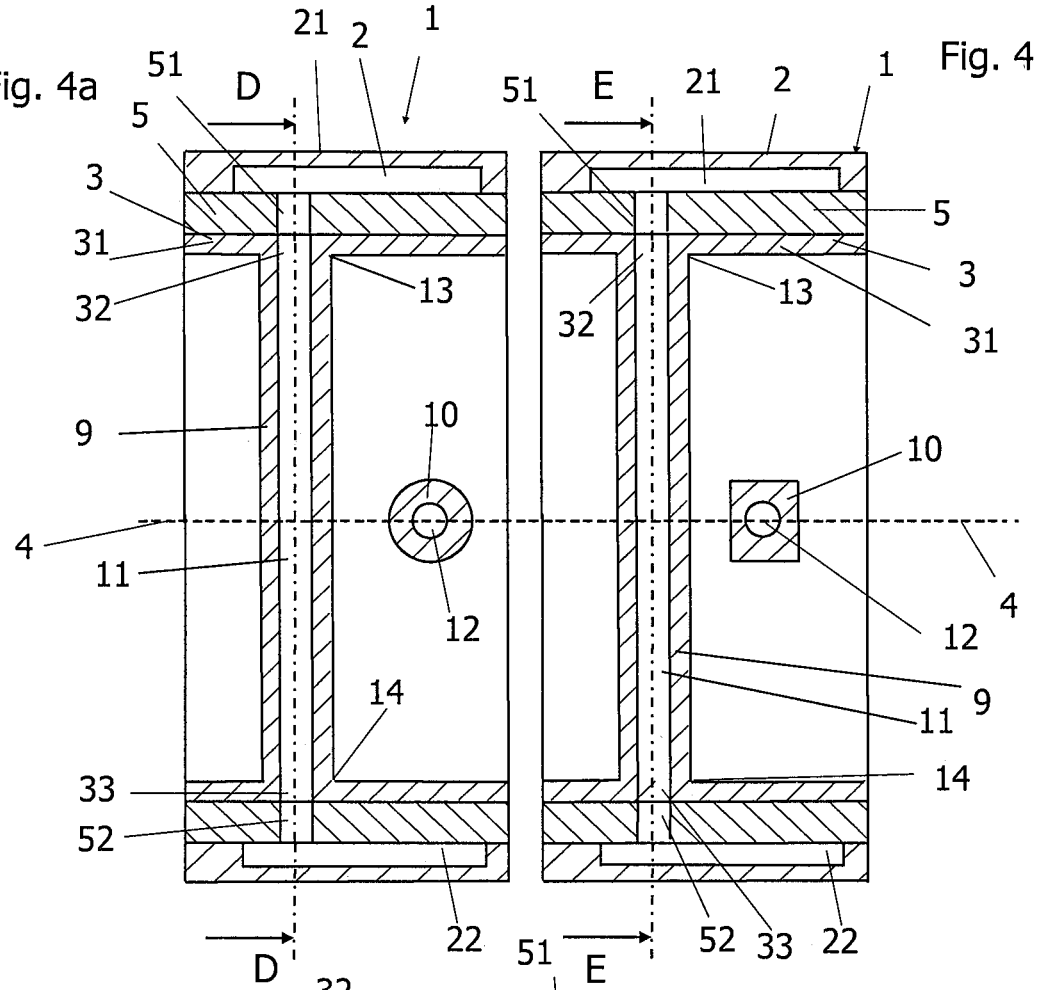
Fig. 4b
Fig. 4c
D-D
E-E
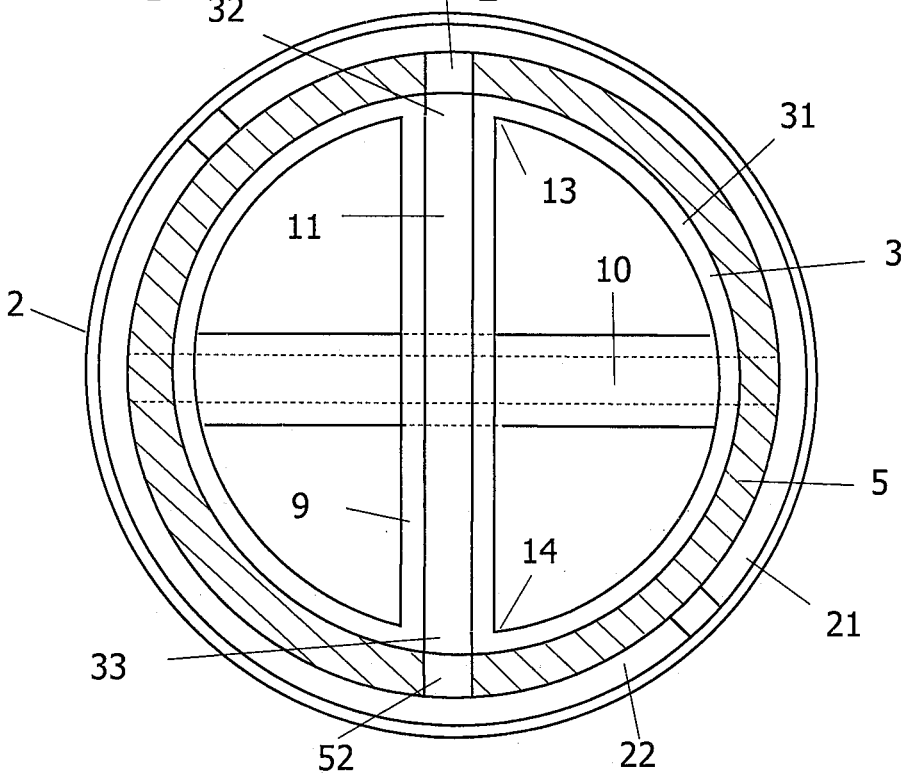

HEAT EXCHANGER

TECHNICAL FIELD

The invention relates to a heat exchanger, which can be manufactured economically, which can be used also as static mixer or a static mixer, which can also be configured as a heat exchanger at the same time or can include the function of a heat exchanger. The heat exchanger is particularly suitable for cooling or heating flowable media, such as fluids, wherein the fluids may include, for example, viscous or highly viscous fluids, in particular polymers.

Heat exchangers are used in many areas of the processing industry. According to an embodiment, a flowable medium can be moved over at least one stationary insert element. The insert element usually contains built-in elements, which cause a deflection of the fluid flow or of the flowable medium, which is guided through the interior of the insert element, which is bounded by an insert jacket element. A heat transfer fluid flows through the built-in elements. The flowable medium flows through the insert element and thereby generates a pressure gradient. The pressure gradient can be generated for example by the use of pumps.

DESCRIPTION OF RELATED ART

A heat exchanger and static mixer is shown in the document DE 689 05 806 T2, which has tubes of circular cross-section, such that a heat exchange from the tubes to the material flowing between the tubes can be obtained. The jacket of the heat exchanger containing the tubes has to be configured in a thick-walled manner under high interior pressures. The document EP 1 123 730 A2 also shows a heat exchanger and a static mixer which contains tubes as mixing elements.

A variant of such a heat exchanger and static mixer is shown in EP 1 384 502 A1. As shown in EP 0 967 004 A1, the passages for a heat exchange fluid are arranged substantially transversely with respect to the direction of main fluid flow. The passages of EP 1 384 502 A1 are arranged inside finned tubes. For example, the ribs can protrude into the fluid flow in a star shape. There is also a small deflection at these ribs or transverse displacement of the fluid flow, which is also limited locally to the environment of the ribs. Since the ribs are not flowed through by a heat transfer fluid, they offer only a limited effective heat exchange surface and require a relatively large amount of space. Therefore, a denser packing of tubes, which can be passed through by the heat transfer fluid, cannot be realized, and accordingly, the obtainable heat exchange area is reduced.

In the case of laminar flowing media, the mixing effect takes place through layer formation and their rearrangement. By local mixing is meant a cross-mixing in the immediate vicinity of the finned tube, that is an environment that is limited in its size to twice the tube diameter and extends at most to the end of the ribs. A plurality of tubes is juxtaposed transversely to the flow direction. This means that in the case of two tubes, at most half of the fluid arriving as secondary partial flow is guided along the edges of the ribs and can thereby cause a transverse mixing. Again, a plurality of tubes are arranged side by side transversely to the main flow direction. The transverse mixing taking place only over part of the cross section can also lead to the formation of locally different heat profiles and concentration profiles, which may have the consequence that no homogenous mixture can be obtained with such a heat exchanger and static mixer. Homogeneous mixing can only be ensured if a portion of the fluid is cross-mixed over a majority of the entire cross-section. Adjacent partial flows, which are divided by adjacent tubes, are not affected by this mixing, therefore, the mixing takes place only locally.

A device for static mixing and heat exchange according to EP 2851118 B1 comprises a jacket element and a mixer insert, wherein the mixer insert is arranged in the operating state in the interior of the jacket element. The mixer insert comprises a first group of web elements and a second group of web elements, the first group of web elements extending along a common first group plane and the second group of web elements extending along a second common group plane. The group plane is thus characterized by containing the center axis of the web elements. At least a portion of the web elements contain passages, the passages extending from a first end of the web element to a second end of the web element. The jacket element in each case contains a corresponding passage which is in fluid-conducting connection with the first and second ends of the web element, wherein the transition from at least one of the first and second ends of the web element to the respective corresponding passage in the jacket element is without gap.

If such a device is used to process highly viscous fluids, such as polymer melts, the static mixers used there typically have to withstand nominal pressures of 50 to 400 bar and temperatures of 50 to 300 degrees Celsius, so that the jacket of the insert element is formed as a thick-walled tube.

It has been found that the production of heat exchangers with thick-walled tubes is very complicated and expensive and, depending on the manufacturing process, qualitative problems can also occur. The production by casting or by an additive manufacturing process incur high costs, which usually increase linearly with the weight. The one-piece casting of thick-walled tubes with a complex interior of webs is technically very demanding and often leads to quality problems. If the usually very complex web structure is to be connected in the interior space, for example by soldering or welding with the outer tube, it is very expensive in a thick-walled outer tube due to the weight and the resulting difficult handling. Since the wall thickness of such heat exchangers depend on the pressure and temperature of the application and can vary accordingly, they must be manufactured individually according to specification which significantly increases the cost of production and greatly increases the delivery times since prefabrication is not possible. There is therefore a need to develop a heat exchanger, in particular for highly viscous fluids, which is less expensive to produce.

The object of the invention is therefore to provide a heat exchanger and optionally a static mixer, which is suitable for the processing of highly viscous fluids and can withstand a correspondingly high fluid pressure, but is easier to produce. The object of the invention is also to provide a heat exchanger in a modular design, which is individually adaptable to different fluid pressures.

SUMMARY OF THE INVENTION

When the term "for example" is used in the following description, this term refers to embodiments and/or variants, which is not necessarily to be understood as a more preferred application of the teachings of the invention. Similarly, the terms "preferable," "preferred," are to be understood to refer to an example of a variety of embodiments and/or variants, which is not necessarily to be understood as a preferred application of the teachings of the invention. Accordingly, the terms "for example," "preferably," or "preferred," may refer to a plurality of embodiments and/or variants.

The following detailed description includes various embodiments of a heat exchanger. The description of a particular heat exchanger is to be considered as exemplary only. In the specification and claims, the terms "including," "comprising," "having" are interpreted as "including, but not limited to."

The heat exchanger according to the invention comprises a jacket element and an insert element, wherein the insert element is arranged in the operating state in the interior of the jacket element. The insert element has a longitudinal axis that extends substantially in the direction of the flow of the flowable medium. The direction of the flow will be referred to hereinafter as the main direction of flow.

The insert element contains an insert jacket element and at least one web element, in particular a plurality of web elements. The web element has a first end and a second end. The first end and the second end of the web element are connected to the insert jacket element at various locations. The web element includes a web element channel, wherein the web element channel extends from the first end of the web element to the second end of the web element. If a plurality of web elements is provided, at least a portion of the web elements may include web element channels. The jacket element may include a jacket channel, which is in fluid communication with the web element channel. Between the insert jacket element and the jacket element, an intermediate jacket element is arranged.

The insert jacket element can thus be accommodated in the intermediate jacket element, wherein the insert jacket element can be inserted into the intermediate jacket element. The insert jacket element can be inserted into the intermediate jacket element after its completion. In the operating state, the intermediate jacket element absorbs the fluid pressures which act on the insert jacket element and are transferred from the insert jacket element to the intermediate jacket element. Therefore, it is possible that the insert jacket element has an average wall thickness which is smaller than the mean wall thickness of the intermediate jacket element. The insert jacket element and the intermediate jacket element can be arranged at least partially adjacent to one another. In particular, the intermediate jacket element can rest on the insert jacket element with a lateral surface portion of 80% to 100%. In particular, the outer surface of the insert jacket element can rest completely against the jacket inner surface of the intermediate jacket element.

Another advantage lies in the fact that a single insert element is required, but the heat exchanger can still be used in a large pressure range of the flowable medium, which flows around the web element or the web elements. The pressure range can range from ambient pressure to over 600 bar pressure. The insert element is held in an intermediate jacket element, which is designed for a certain maximum pressure. In particular, the insert element can be combined with intermediate jacket elements of different wall thickness. With increasing wall thickness, a higher pressure resistance of the heat exchanger is obtained with the same nominal diameter. In other words, it is sufficient to use the heat exchanger in the corresponding intermediate jacket element and jacket element. Since the intermediate jacket elements and the jacket elements are much easier to manufacture than the insert element, storage can be optimized as only the insert elements of different nominal diameter and optionally different length must be kept in stock.

The intermediate jacket elements and jacket elements can only be manufactured after receipt of the order in accordance with the customer's specification for the pressure of the flowable medium required by the customer, since their production can take place as required within a short time.

In addition, any arrangements of web elements can be realized. The web elements can have any dimensions. In addition, the outer side of the insert jacket element before installation of the same in the intermediate jacket element is easily accessible on all sides, which makes it possible to connect the web element or the web elements at arbitrary locations in any spatial directions with the insert jacket element, for example by soldering, welding, clamping or gluing.

The insert jacket element can include an insert jacket channel which is fluidly connected to a web element channel. In particular, the insert element jacket channel can be fluidly connected to an intermediate jacket element channel. According to one embodiment, the intermediate jacket element channel is fluidly connected to the jacket channel. The jacket channel may extend over 20% to 90% of the jacket element inner surface facing the intermediate element. The jacket element channel can be in fluid-conducting connection with the web element channel or the web element channels. The jacket element channel may include a plurality of jacket element chambers. The jacket element channel can contain a supply line for a heat transfer fluid and a discharge for the heat transfer fluid.

According to an embodiment, each of the jacket element chambers may contain either the feed or the discharge for the heat transfer fluid. In particular, each of the supply lines or outlets may be connected to a plurality of intermediate jacket element channels. A jacket element chamber may be formed as a heat transfer fluid distributor when the jacket element chamber contains a supply line. A jacket element chamber may be formed as a heat transfer fluid collector when the jacket element chamber contains a drain.

According to any one of the preceding embodiments, the web elements may be connected to the insert jacket element by gluing, soldering, casting, an additive manufacturing method, welding, clamping, shrink-fitting, or combinations thereof. Gluing, soldering or welding can be performed from inside and/or outside. In particular, the insert jacket element and the web elements can be formed integrally.

According to an embodiment, the insert element and the intermediate jacket element may contain different materials.

According to an embodiment, the wall thicknesses of the insert element and the intermediate jacket element together may amount to at least 10 mm. In particular, the wall thicknesses of the insert element and the intermediate jacket element together may amount to at least 20 mm.

According to an embodiment, the web element channel can be kink-free. According to an embodiment, the web element channel can pass without kinking in the intermediate jacket element channel or the intermediate jacket element channels.

At least a part of the web elements thus extends over the entire width dimension or the diameter of the jacket element. The web element channels in the web elements extend from the first end to the second end of the web element, which adjoins directly to the inner wall of the intermediate jacket element. According to one exemplary embodiment, there is an intermediate jacket element channel in the intermediate jacket element which adjoins the insert jacket element channel. The web elements can thus be fed by the jacket element through the intermediate jacket element channels of the intermediate jacket element and the insert jacket element channels with a heat transfer fluid, in particular a heat transfer liquid, and be flowed through by the heat transfer fluid. The length of the web element channel corresponds at least to the mean diameter of the insert jacket element when the web element contains the longitudinal axis.

The mean diameter corresponds to the inner diameter when the insert jacket element is designed as a circular tube. The mean diameter for a square insert jacket element is defined as its circumference/n (pi), thus an equivalent diameter. The length of the web element channel may in particular be at least 10% above the mean diameter when the web element channel crosses the center axis. The length of this web element channel may in particular be at least 20% above the mean diameter, more preferably at least 30% above the mean diameter.

A web element is characterized by its dimensions, thus by its length, its width and its thickness. The length of the web element is measured from the first end of the web element to the second end of the web element. The length of the web element channel substantially corresponds to the length of the web element.

The width of the web element is measured essentially transversely to the flow direction. That is, the width extends substantially in a plane that is normal to the length of the web element and shows the cross section of the web element. The cross section of the web element is characterized by its width and thickness. The length of at least the longest web element is at least 5 times as large as its width.

The width of the web element is 0.5 to 5 times as large as its thickness, advantageously 0.75 to 3 times as large as its thickness. If the width of the web element is 1 to 2 times as large as its thickness, a particularly preferred range results, for which particularly good cross-mixing can be achieved. The width of the web element is defined as the normal distance which extends from the first edge and the second edge of the web element on the upstream side. The width of the web element on the upstream side may differ from the width measured on the downstream side of the web element.

The term "edge" is understood to mean the edge of the web element which is exposed to the flowing fluid such that the fluid flows onto an around the edge, which edge extends substantially parallel to the length of the web element. The thickness of the web element can be variable. The minimum thickness is less than 75% and advantageously less than 50% below the maximum thickness. The variations may be due, for example, to ribs, to indentations, to knobs, to wedge-shaped webs or to other unevenness.

The web element may be characterized in that flat surfaces, convex or concave surfaces are present in the flow direction, which provide an impinging surface for the flowing fluid. These surfaces aligned in the flow direction cause an increased flow resistance, especially in comparison with a tubular element, which can result in an improved heat transfer.

The web element channel, which runs in the interior of the web element, preferably has an inner diameter which corresponds to a maximum of 75% of the thickness of the web element. In principle, a plurality of substantially parallel web element channels can be contained in a web.

The transition from at least one of the first and second ends of the web element to the insert jacket element is gap-free according to an embodiment. The web elements of the insert element and the insert jacket element therefore consist according to an embodiment of a single component, which is preferably produced by a casting process. A characteristic property of the gap-free transition is a smooth transition from the web element to the insert jacket element. In particular, curves may be provided at the edges in the transition region from the web element to the insert jacket element, so that the flow of the castable material is not impaired during the production process.

The web element channels run in the interior of the web elements, so that there exists no connection between the channels in the interior of the web elements and the space surrounding the web elements.

In a casting process, a monolithic structure is produced at least in segments consisting of first and second groups of web elements arranged at a non-zero angle with respect to the main flow direction and a fixed insert element permanently connected to at least a portion of the web elements, which can be formed as a jacket tube. Instead of a casting process, an additive manufacturing process can also be used.

Alternatively, there is also the possibility that the recesses of the insert jacket element, coincide with the outer contour of the web element. The web element can be pushed through the recess of the insert jacket element according to this embodiment and be positioned in the interior of the insert jacket element. According to this embodiment, the web element can be connected to the insert jacket element by gluing, soldering, welding, clamping, press-fitting or shrink-fitting.

The web elements contain at least partially web element channels, which can be flowed through by a heat transfer fluid in the operating state. In the operating state, the web element channels are not in connection with the flowable medium which flows around the web elements. The web element channels extend from a first end of the web element to a second end of the web element. The insert jacket element in each case contains a corresponding insert jacket channel, which is in fluid-conducting connection with the first end and second end of the web element, wherein the transition from at least one of the first and second ends of the web element to the respective corresponding insert jacket channel in the insert jacket element is free from gaps.

The web element channels for the heat transfer fluid in the web elements can be produced by the casting process or an additive manufacturing process described earlier, but also by subsequent processing such as eroding or drilling.

In the casting process, for example, a casting mold is produced by means of a wax body, applying a ceramic shell to the wax body, then removing the wax and burning the ceramic shell, and filling the burnt ceramic shell with pourable material. The castable material is solidified by cooling and the ceramic shell removed after solidification of the castable material. The device can be made of any materials that can be processed by casting, such as metal, plastic or ceramic.

The web elements are advantageously designed in a rectangular shape, the edges can also be rounded. However, the web elements can also have a different cross-sectional shape including a shape from the group of circles, ellipses, rounded squares or polygons. The cross-sectional areas may be different in a single web element or between a plurality of web elements, for example, the web element thickness or the web element width may vary. The insert jacket element may have any closed cross-section and/or any desired geometry, for example as a tube or a rectangular channel.

A heat transfer fluid may include any liquid such as water or oils but also a gas such as air.

The web elements may be disposed at an angle of approximately 25 to 75 degrees, in particular at an angle of approximately 30 to 60 degrees to the main flow direction. The web elements can form web element groups, wherein the web elements of each web element group can be arranged parallel to one another. The web elements of a web element group can be located in a common group plane. In one embodiment, the first and second group planes intersect. According to a further embodiment, a web element of the first group adjoins a web element of the second group. Accordingly, adjacent web elements according to this embodiment have a different orientation, since they belong to different groups.

According to a preferred embodiment, adjacent web elements intersect, since an improved heat exchange can be achieved in this way. The angle between two intersecting web elements is advantageously 25 to 75 degrees. In a group any number of web elements can be arranged side by side. The group is characterized in that the center axes of all the web elements span the same or essentially the same group plane. In particular, 2 to 20 web elements, particularly preferably 4 to 12 web elements, are arranged in parallel in a group.

Any number of groups of web elements can be arranged one behind the other in the main flow direction. The successively arranged groups are advantageously arranged so that they overlap so as to accommodate as much active heat exchange surface in a small apparatus volume as possible. Overlapping means that at least a part of the web elements of a first group and a part of the web elements of a subsequent group and/or a preceding group are arranged in the same tube section, viewed in the main flow direction. The projection of the length of the tube element on the longitudinal axis gives a length L1 and the projection of the overlapping part of the tube elements of the adjacent group on the longitudinal axis results in a length L2, wherein L2 is smaller than L1 and L2 is greater than 0. The considered tube section is defined such that it has the length L1, thus, it extends from a centrally disposed web element from the first end to the second end in the projection on the longitudinal axis.

Since the mixing action takes place only in one plane in serial groups of web elements with their web elements arranged in parallel, after a certain number of groups the orientation is changed such that the groups are advantageously arranged offset from one another. In particular, two to 20 groups are provided, more preferably 4 up to and including 8 groups. The offset between the identically aligned groups advantageously is at an angle of 80 to 100 degrees. This means that the second group is aligned about the longitudinal axis by an angle of 80 to 100 degrees with respect to the first group.

In addition to the groups of intersecting web elements described above, groups which comprise web elements which extend only from the inner wall of the jacket element to the intersection line with the respective other group may be arranged especially in the terminal region of identically aligned parallel groups of web elements. Hereinafter, these groups will be referred to as half intersecting web element groups. These groups lead to an additional increase in mixing performance. Due to the better mixing effect and the additional heat conduction effects of the web material, the heat exchange is additionally increased.

According to an embodiment, the web elements may form a first and a second group. Each of the first and second groups may span a first and second group plane, respectively. More particularly, the first group plane of the first group and the second group plane of the second group may cross in such a way that a common intersection line is formed, which has a point of intersection with the longitudinal axis or is arranged substantially transverse to the longitudinal axis and/or has a minimum distance from the longitudinal axis in a plane perpendicular to the intersection line, which contains the longitudinal axis. According to an embodiment, at least one group of web elements may be provided, which extend substantially to the intersection line. The web elements in a first and second group can touch each other or have gaps between them. Also, a connection of the intermediate spaces with connecting webs arranged transverse to the fluid flow direction is possible.

The heat transfer fluid is advantageously supplied to the jacket element and flows through a jacket channel located in the jacket element. The jacket channel adjoins the intermediate jacket element. The intermediate jacket element has openings leading to the insert jacket channels. From there, the heat transfer fluid enters at least part of the web element channels of the web elements. As a result, not only the surface of the inner wall of the insert jacket element, but also the surface of the warmed or cooled web elements can be used as a heat exchange surface. The jacket channel can be formed on the inside by the intermediate jacket element and on the outside by the jacket element. An inlet and a drain for the heat transfer fluid can be provided in the jacket element. In particular, the jacket element may contain connections for the supply and removal of the heat transfer fluid. The jacket channel can contain a plurality of jacket element chambers, wherein in at least one jacket element chamber the heat transfer fluid can be distributed to a part of the intermediate jacket element channels. The heat transfer fluid can be collected by the intermediate jacket element channels in at least one second jacket element chamber, so that the heat transfer fluid flows through the heat exchanger as uniformly as possible. It is also possible that the heat transfer fluid flows through different sections or segments of the heat exchanger by separate jacket channels, so that the heat exchanger contains different sections or segments which can be flowed through by heat transfer fluid of different temperatures. A different temperature profile can be obtained in the individual segments. It has been shown that, for achievement of a high heat transfer in a small apparatus volume with jacket element diameters of 60 mm and more, at least half of all web elements should be flowed through by the heat transfer fluid.

It has been found that both a casting method, an additive manufacturing method, a soldering method, an adhesive method, a shrink-fitting method, a clamping method and a welding method can be cost-effective manufacturing methods for web elements and a gap-free insert jacket element connected to the web elements monolithically, when the insert jacket element is surrounded by an intermediate jacket element, which can withstand a high pressure load in the operating state. The insert element can be made in one piece, comprising the insert jacket element with the corresponding web elements. Alternatively, the insert element consists of individual segments, which are subsequently connected, for example by welding or by bolted flanges or by clamping. Furthermore, the outer geometry of the web elements and the web element geometry as well as the geometry of the web element channels for the heat transfer fluid can be easily decoupled both for a welding process and for a casting process. Thus, for the outer geometry of the web elements advantageously rectangular profiles can be used and the web element channel geometry can advantageously be selected as a round cross-section, that is, in particular a circular or oval cross-section. Therefore, web elements with an ideal profile for cross-mixing and/or high inherent strength for large maximum fluid pressures can be produced. It has been found that the web element channels for the heat transfer fluid in the web elements are advantageously produced after the casting process by erosion and more advantageously by drilling, so that web element channels with small diameters can also be produced.

It has further been shown that with the groups of web elements according to the invention and especially with groups in which adjacent web elements intersect, and/or especially with overlapping groups of web elements, a very good heat transfer and/or mixing performance can be produced. In particular, the arrangement of a second group, which is offset by 80 to 100 degrees to the first group, can be conducive to a good heat transfer. Surprisingly, it has also been shown that especially the attachment of additional subgroups and, especially with viscous fluids, a further improvement of the heat transfer and/or the mixing performance can be achieved.

Also, the heat transfer and/or the mixing performance in the vicinity of the inner wall of the insert jacket element is substantially improved by the direct transition of the web elements in the insert jacket element, as boundary layers of the flowable medium in vicinity of the inner wall are also involved to achieve optimal heat transfer or a homogeneous mixture. In particular, not only an optimal renewal of the boundary layers between flowable medium and insert jacket element, but also between flowable medium and web element surface can be generated. An optimal boundary layer renewal therefore leads to an optimal use of the heat exchange surface. The optimal use of the heat exchange surface also means that the heat exchanger can be built for a given cooling or heating task with very small apparatus volume and with very little pressure loss.

Due to the optimized heat transfer, the heat exchanger according to the invention exhibits a very narrow residence time spectrum of the flowable medium to be heated or cooled. As a result, deposits or decomposition of flowable medium can be prevented as best as possible. In cooling tasks involving the cooling of a viscous fluid, such as a polymer, a very low melt temperature close to the freezing point of can be obtained as a consequence of the optimal renewal of the boundary layers. In this way, in particular, it is avoided that solidified polymer deposits on the heat exchange surfaces. The direct transition of the individual web elements in the insert jacket element and the housing of the insert element in the intermediate jacket element leads to a very stable construction, which is also suitable for the operation with high fluid operating pressures. As a result, the inventive heat exchanger can be built very compact especially for operation with viscous fluids. The device is basically suitable for mixing and cooling respectively heating of any flowable media such as liquids and gases, but especially for viscous and very viscous fluids such as polymers.

The jacket element, the intermediate jacket element and the insert element may contain castable or weldable materials, for example, metals, ceramics, plastics or combinations of these materials may be used.

A method for operating a heat exchanger comprises the following method steps, wherein the heat exchanger comprises an insert element and a jacket element, wherein the insert element comprises at least one web element arranged at a non-zero angle to the main flow direction and an insert jacket element fixedly connected to the web element, wherein the web element includes a web element channel, which is flowed through in the operating state by a heat transfer fluid, which is not in communication with the flowable medium, which flows around the web element. The web element channel extends from a first end of the web element to a second end of the web element. The jacket element can contain a jacket channel which is in fluid-conducting connection with the web element channel. Between the insert element and the jacket element, an intermediate jacket element is arranged which contains a first intermediate jacket element channel and a second intermediate jacket element channel through which the heat transfer fluid flows, so that the heat transfer fluid flows from the jacket channel through the first intermediate jacket element channel in the web element channel, passes through the web element channel and flows from the web element channel through the second intermediate jacket element channel into the jacket channel.

A method for producing a heat exchanger which includes an insert element and a jacket element, wherein the insert element has at least one web element arranged at a non-zero angle relative to the main flow direction and an insert jacket element fixedly connected to the web element comprises the following method steps. The web element and the insert jacket element are produced by gluing, a soldering method, a casting method, an additive manufacturing method, a welding method, a clamping method or a shrink-fitting method, or combinations thereof. The web element includes a web element channel which is produced by the casting process together with the insert jacket element or is produced in a further working step by means of a drilling process or an erosion process. A web element channel extends from a first end of the web element to a second end of the web element, wherein the insert element is positioned in the jacket element. The jacket element may include a jacket channel, which in the assembled state is in fluid-conducting connection with the web element channel. Between the insert element and the jacket element, an intermediate jacket element is arranged, which contains a first intermediate jacket element channel and a second intermediate jacket element channel, wherein the intermediate jacket element is positioned in the jacket element and the insert element is positioned in the intermediate jacket element such that the heat transfer fluid from the jacket channel through the first intermediate jacket element channel in the web element channel can flow through the web element channel and can flow from the web element channel through the second intermediate jacket element channel into the jacket channel.

The use of an intermediate jacket element has several advantages. Thus, the insert element can be made much thinner and lighter. Therefore, for the insert element, a different material, for example, a higher quality material, can be used as for the intermediate jacket element. In particular, the insert element may contain a material which has a high thermal conductivity or a high resistance to chemicals, for example a high corrosion resistance. The insert element may be integrally formed with the web elements by an additive manufacturing method or casting method. Since the production of the insert element is very expensive, it can be placed as a semi-finished product in stock and the intermediate jacket element can be adjusted to the required wall thickness depending on the application and nominal pressure. The jacket element, which surrounds the intermediate jacket element, can be designed as a further double jacket, through which the heat transfer fluid flows in the operating state. The heat transfer fluid passes through the openings in the jacket element and in the intermediate jacket element and in the insert jacket element to at least one of the web elements, so that it can flow through the web element or elements.

BRIEF DESCRIPTION OF THE DRAWINGS

In the following, the heat exchanger according to the invention according to some embodiments is shown in the figures. It is shown in FIG. 1*a*: a longitudinal section through a heat exchanger according to a first embodiment, FIG. 4*b*: a longitudinal section through a heat exchanger according to a fifth embodiment, FIG. 4*c*: a radial section through the heat exchanger according to FIG. 4*a* or FIG. 4*b*.

DETAILED DESCRIPTION

Figure 1A:
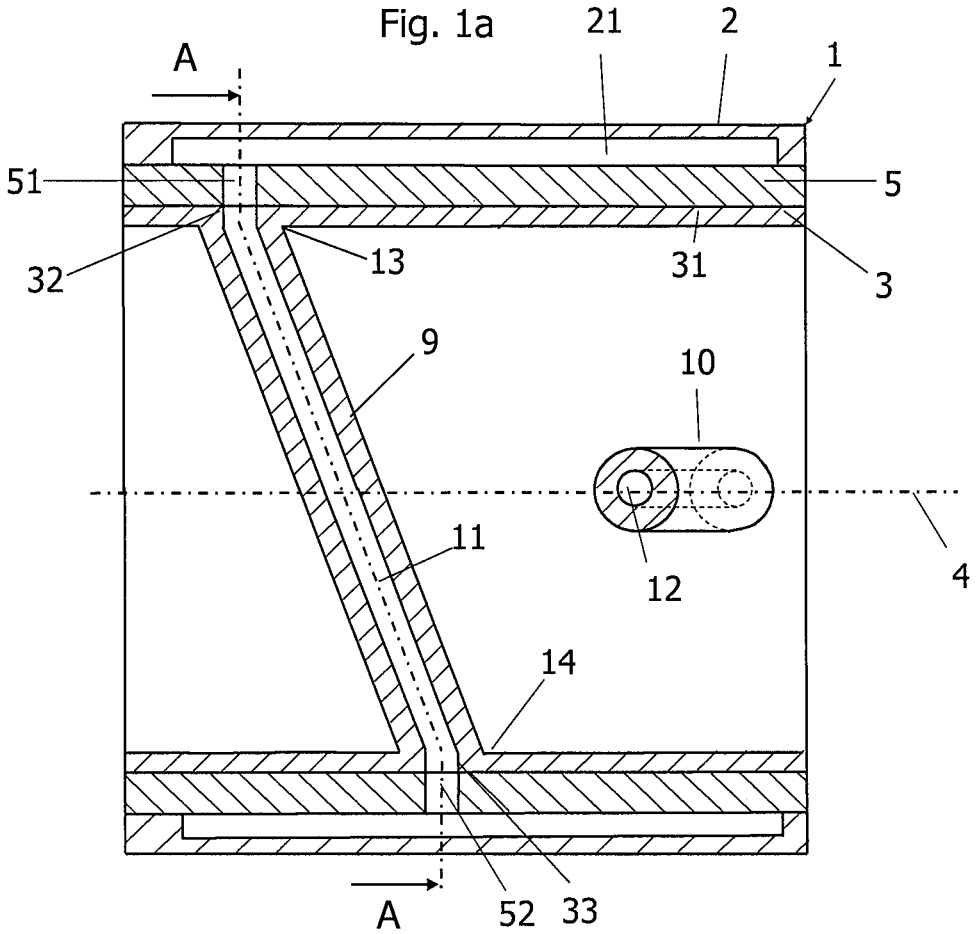
FIG. 1*b*: a radial section through the heat exchanger according to FIG. 1*a*, FIG. 2*a*: a longitudinal section through a heat exchanger according to a second embodiment.

FIG. 1*a* shows a longitudinal section through a heat exchanger according to a first embodiment. The heat exchanger 1 for static mixing and heat exchange according to FIG. 1*a* contains a jacket element 2 and an insert element 3, the insert element 3 being arranged in the interior of the jacket element 2 in the operating state. The jacket element 2 is designed as a hollow body. The insert element is received in the hollow body. The insert element 3 has a longitudinal axis 4, which extends essentially in the main flow direction of the flowable medium, which flows through the jacket element 2 in the operating state. The insert element 3 contains an insert jacket element 31 and at least one web element 9, 10. The web element 9, 10 has a first end 13 and a second end 14, the first end 13 and the second end 14 of the web element 9, 10 is connected to the insert jacket element 31 at different locations. The web element 9, 10 contains a web element channel 11, 12. The web element channel 11, 12 extends from the first end 13 of the web element 9, 10 to the second end 14 of the web element 9, 10. The jacket element 2 includes a jacket channel 21, which is fluidly connected to the web element channel 11, 12. Between the insert jacket element 31 and the jacket element 2, an intermediate jacket element 5 is arranged.

FIG. 1*a* shows a first web element 9, through which the longitudinal section is laid, so that its web element channel 11 is visible and a second web element 12, which is shown cut open, so that the projection of its cross-sectional area in the sectional plane is visible. This arrangement is to be regarded as exemplary only, that is, the heat exchanger could also contain only a single web element 9 or even more web elements.

The length of a web element 9 is understood to mean the dimension from the first end 13 to the second end 14 of the web element 9 along its center axis. The thickness of the web element means the dimension normal to the center axis from one edge to the opposite edge. In particular, the thickness in the case of tubular web elements can correspond to the diameter of the web element 9.

The web element channel 11 may open into a first insert jacket channel 32 at the first end 13 of the web element 9. The first insert jacket channel 32 extends through the insert jacket element 31 from its inner wall to its outer wall. The insert jacket channel 32 may extend in the radial direction according to the present embodiment.

The web element channel 11 can open at the second end 14 of the web element 9 into a second insert jacket channel 33. The second insert jacket channel 33 extends through the insert jacket element 31 from its inner wall to its outer wall.

Figure 1B:
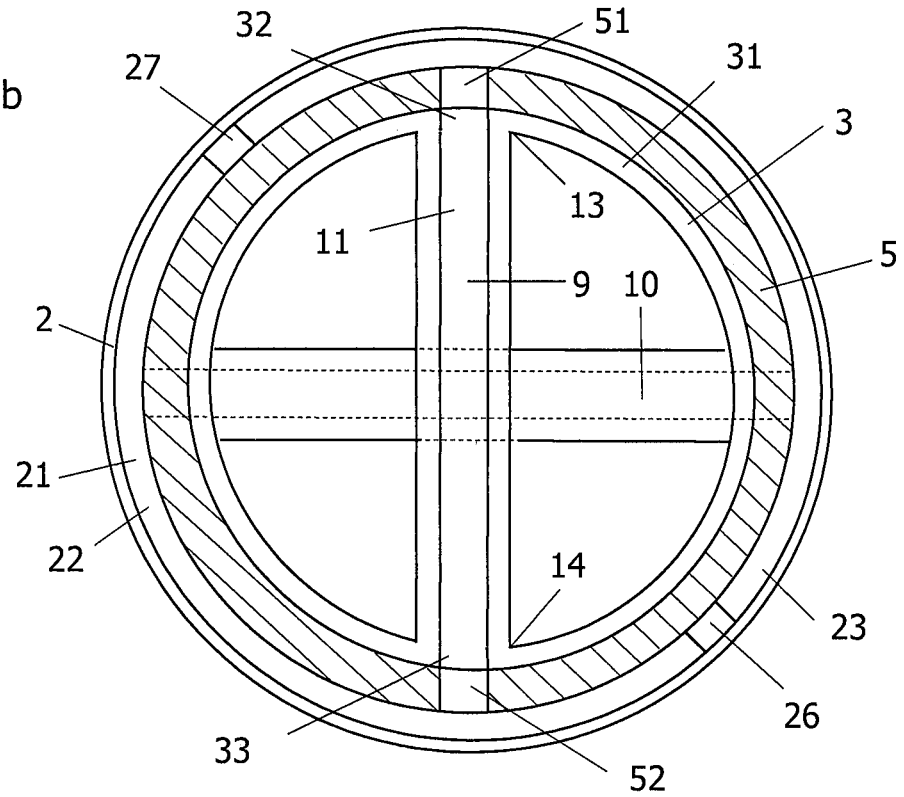

FIG. 1*b* shows a radial section through the heat exchanger 1 according to FIG. 1*a*. The radial section is laid through the web element channel 11 to illustrate its course. The intermediate sheath element 5 is hatched, the hatching of the insert element 3 and of the sheath element 2 are omitted in order to keep the representation clear. The space enclosed by the insert element 3 contains the flowable medium, for example a polymer melt. The web elements 9, 10 are flowed around by the flowable medium in the operating state. The flowable medium impinges on the web element 9, whereby the flow of the same is divided and deflected. The divided and deflected stream of the flowable medium impinges on the downstream web element 10, through which the divided and deflected stream of the flowable medium is divided again and deflected. A progressive division and deflection of the flow of the flowable medium leads to its heat exchange and/or mixing. A heat transfer fluid can flow through the web element channels 11, 12, which serves for heating or cooling of the flowable medium. In the sectional view according to FIG. 1*b*, it is shown in particular for the web element channel 11, that a continuous connection to the jacket element chamber 22 exists from the jacket element chamber 23 of the jacket element 2. The intermediate jacket element 5 includes an intermediate jacket element channel 51 which forms a connection between the jacket element chamber 23 and the insert jacket channel 32. The web element channel 11 is arranged downstream of the insert jacket channel 32. The insert jacket channel 33 is arranged downstream to the web element channel 11. The insert jacket channel 33 is connected to the jacket element chamber 22 via the intermediate jacket element channel 52. The supply of the heat transfer fluid to the jacket element chamber 23 and the discharge of the heat transfer fluid from the jacket element chamber 22 is not shown in this drawing. The jacket element chamber 22 is separated from the jacket element chamber 23 by a first separation element 26 and a second separation element 27 so that a heat transfer medium supplied to the heat exchanger with a temperature T1 can not be mixed with a heat transfer fluid having a temperature T2 discharged from the heat exchanger and efficient cooling or heating the flowable medium can take place.

Figure 2A:
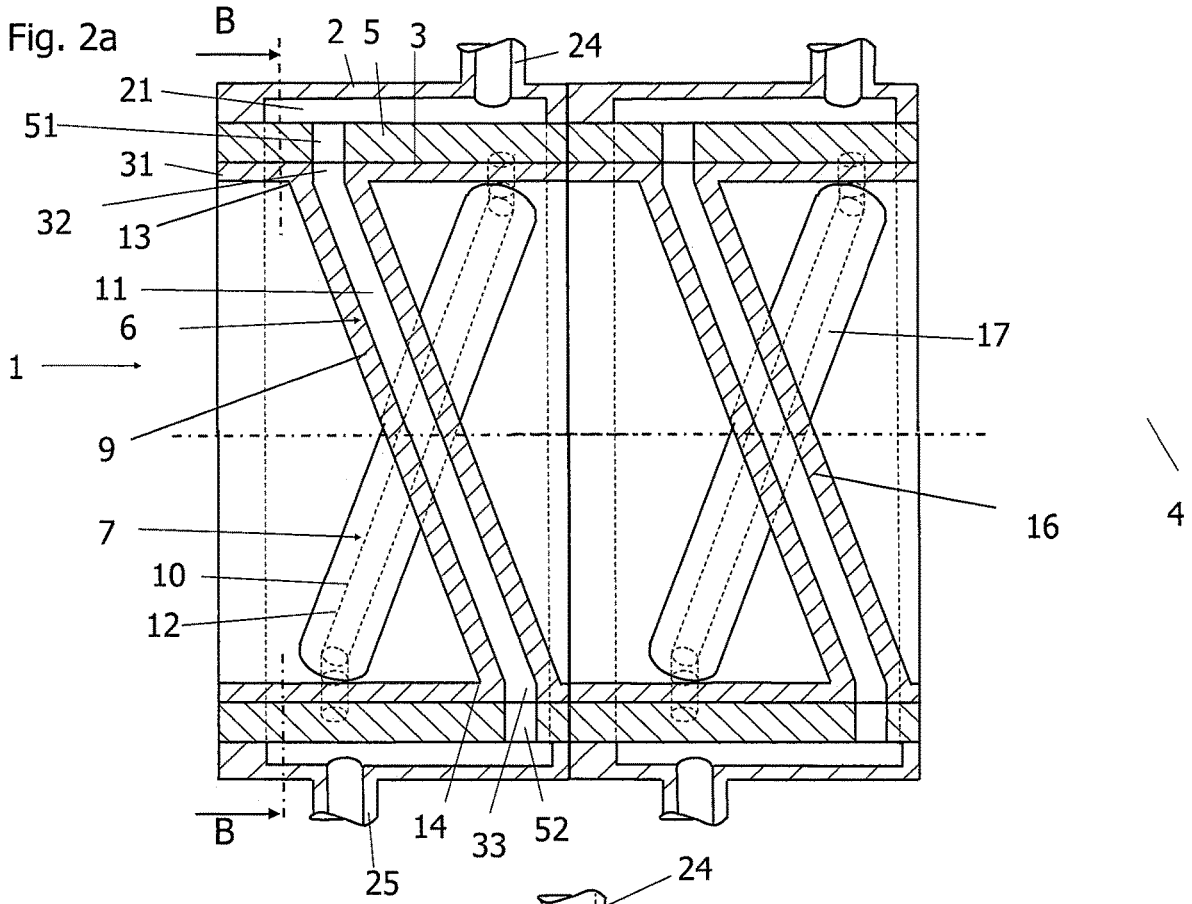
FIG. 2*b*: a radial section through the heat exchanger according to FIG. 2*a*, FIG. 3*a*: a longitudinal section through a heat exchanger according to a third embodiment.

FIG. 2*a* shows a longitudinal section through a heat exchanger 1 according to a second embodiment. The heat exchanger 1 comprises an insert element 3, an intermediate jacket element 5 and a jacket element 2. The insert element 3 comprises a first and second group 6, 7 of web elements 9, 10 fixed to a non-zero angle with respect to the main flow direction and fixedly connected to at least a part of web elements 9, 10 connected insert jacket element 31. The web elements 9, 10 include web element channels 11, 12. These web element channels 11, 12 are flowed through in the operating state by a heat transfer fluid. The heat transfer fluid is not in communication with the flowable medium, which flows around the web elements 9, 10, FIG. 2*a* shows a first insert element 3 and a second insert element 3, which have the same structure. For each of the first and second insert elements 3, an intermediate jacket element 5 and a jacket element 2 can each be provided. Alternatively, each of the first and second insert elements 3 or the intermediate jacket elements 5 or the jacket elements 2 can each form a single component, which is not shown in the drawing. Each of the first or second insert elements 3 comprises a first group 6 of web elements 9, 10 and a second group 7 of web elements 9, 10.

a first group 16, a second group 17 of web elements belonging to the second insert element 3 are further shown in FIG. 2*a*. Since the two insert elements 3 shown, the intermediate jacket elements 5 and the jacket elements 2 are of identical construction, the reference numerals of the right-side insert element 3, the associated intermediate jacket element 5 and the jacket element 2 have been omitted for the sake of clarity. Further groups of web elements can connect to these first and second groups 6, 7, 16, 17, which is also not shown in the drawing. According to the present embodiment, all group pairs have the same structure. Therefore, the following description applies to the first groups 6, 16 and the second groups 7, 17. Each group may comprise a plurality of web elements. 2 to 20 web elements, preferably 4 to 12 web elements of a group can be arranged in parallel to each other depending on the size of the space and/or the width of the web elements.

The first group 6 of web elements 9 extends along a common first group plane. The group plane contains the longitudinal axis of a web element channel 11 running in the interior of the web element 9 when the web element channel 11 is arranged such that its longitudinal axis coincides with the center axis of the web element 9. In the present illustration, the group plane is normal to the plane of the drawing.

The second group 7 of web elements extends along a second common group plane. The second group plane is defined in the same way as the first group plane. The first and second group planes intersect. In this drawing, they intersect exactly on the longitudinal axis 4 of the insert element 3. A web element 9 of the first group adjoins a web element 10 of the second group. The web element 9 is thus arranged crosswise to the web element 10. The web elements of the first group 6 thus alternate with the web elements of the second group 7. The web element 9 is cut along its longitudinal axis, so that one half of the web element channel 11 is visible. The web element 10 is located behind the web element 9 with respect to the plane of the drawing. It is therefore shown in section, and the web element channel 12 extending through the web element 10 is shown only by means of a dashed line. The web element channel 11 of the web element 9 of the first group extends from a first end 13 to a second end 14 of the web element. The web element channel 11, 12 may have a cross-sectional area in the form of a round element. The round element may comprise an element from the group of circles, ellipses, rounded squares or polygons.

According to an exemplary embodiment, the group plane of the first group 6 intersects with the group plane of the second group 7 in such a way that a common crossing line is formed which has an intersection with the longitudinal axis 4 or runs essentially transversely to the longitudinal axis and/or has a minimum distance from the longitudinal axis in a normal plane to the intersection line, which contains the longitudinal axis. By virtue of this arrangement, the web elements 9, 10 have a configuration which is symmetrical with respect to the sectional plane, so that the heat exchange in the subarea of the space located above the longitudinal axis takes place substantially the same way as in the subarea of the space located below the longitudinal axis.

The first and second group planes are arranged at an angle of 25 to 75 degrees to the longitudinal axis 4. In the present illustration, the angle is 30 to 60 degrees to the longitudinal axis 4, in many cases substantially 45 degrees to the longitudinal axis 4.

The jacket element 2 includes a jacket channel 21, which may contain a plurality of jacket element chambers 22, 23. The jacket channel 21 contains a supply line 24 and a discharge line 25 for a heat transfer fluid. The supply line 24 may comprise an inlet connection. The discharge line 25 may include a drain port. The jacket channel 21 includes a distribution channel for the distribution of the heat transfer fluid to a plurality of intermediate element channels 51 and a collecting channel for the collection of the heat transfer fluid from a plurality of intermediate element channels 52. For example, there is an intermediate jacket element channel 51 and an intermediate jacket element channel 52 in fluid-conducting connection with the first and second ends 13, 14 of the web element with each an insert element jacket channel 32 and an insert element jacket channel 33. For each of the web elements 9, 10, which contains a web element channel 11, 12, the insert jacket channel 32 forms a feed channel, which feeds the heat transfer fluid to the corresponding web element channel 11, 12 in the web element 9, 10 and the insert jacket channel 33 forms a discharge channel, which transfers heat transfer fluid from the web element channel 11, 12 in the corresponding web element 9, 10 in the intermediate jacket element channel 52 and the jacket element chamber 23. In FIG. 2*a*, the web element 9 of the group 6 and 16 is shown in each case in section, the web elements 10 of the group 7 and 17 are located in the plane behind it. The web element channels 12 in these web elements 10 are not visible, they are indicated by means of dashed lines.

The transition of the web element channel 11, 12 of at least one of the first and second ends 13, 14 of the web element 9, 10 to the respective corresponding insert jacket channel 32, 33 in the insert jacket element 31 of the insert element 3 is gap-free. The web elements 9, 10 of the insert element 3 can therefore be formed as a single component, which can be produced for example by a welding process or by a shrink-fitting process or by a casting process or by an additive manufacturing process.

The transitions from the insert jacket element 31 to the web element channel 11, 12 may be provided with curves, so that the web elements 9, 10 and the corresponding web element channels 11, 12 can be produced in particular by casting without errors, in particular free of voids, and for optimizing the flow of the flowable medium outside the web elements or also for optimizing the flow of the heat transfer fluid in the web element channels 11, 12 as well as the insert jacket channels 32, 33. The curves are not shown in the drawing. In particular, each of the curves may have a radius of at least 0.5 mm to 10 mm.

Any number of groups 6, 7, 16, 17 of web elements in the main flow direction can be arranged one behind the other. The insert element 3 can also consist only of a first group 6 and a second group 7 of web elements. Therefore, in the description, the first group 6 and the second group 7 are considered representative of a plurality of other similar first or second groups. How many pairs of groups are provided in an individual case depends on the actual heat exchange and/or mixing task. That is, if in the following documents only the first and the second group are described, it can not be deduced that only this particular embodiment is disclosed, but rather embodiments with a plurality of pairs of groups, each of these groups of pairs of first and second a second group is therefore also to be covered by this description. For the sake of simplicity, the description will be limited to one of the group pairs.

Each of the groups may have the same structure as the previous group, the structure of adjacent groups may also differ from each other. Each of the embodiments shown in FIG. 1*a* to FIG. 4*c* can be combined with any other embodiment as desired.

It is also possible, at least in part, to use groups whose web elements do not contain a web element channel. Furthermore, web elements may be provided which form sub-groups. A web element of such a subgroup can extend, for example, only from the insert jacket element 31 to the longitudinal axis 4, which is not shown in the drawing. Such sub-groups may be formed in particular at the beginning or end of the insert element 3. Subgroups can be used in particular to avoid gaps that occur when several heat exchangers are arranged in series. If such a gap persists, the flowable medium will be offered less deflection possibilities and, consequently, the heat exchange may deteriorate or diminish.

According to a variant, the sub-groups forming the end of the insert element can also contain web element channels.

The web element channels 11, 12 are arranged in the interior of the web elements 9, 10, so that no connection consists between the web element channels in the interior of the web elements and the space surrounding the web elements. The space contains the flowable medium in the operating state.

The successively arranged groups may be arranged to overlap so as to provide as much active heat exchange surface as possible in the volume formed by the jacket element 2. Overlapping means that at least a part of the web elements of a first group and a part of the web elements of a following group and/or a part of the web elements of a preceding group are arranged in the same tube section seen in the main flow direction. The projection of the length of the web element on the longitudinal axis results in a length L1 and the projection of the overlapping part of the web elements of the adjacent group on the longitudinal axis results in a length L2, where L2 is smaller than L1 and L2 is greater than 0. The considered tube section is defined so that it has the length L1 representing the envelope volume of the centrally arranged web element 9. The envelope volume is an enveloping cylinder in the case of a cylindrical jacket element with a circular cross section, and an envelope cuboid in the case of a jacket element with a rectangular or polygonal cross section.

Figure 2B:
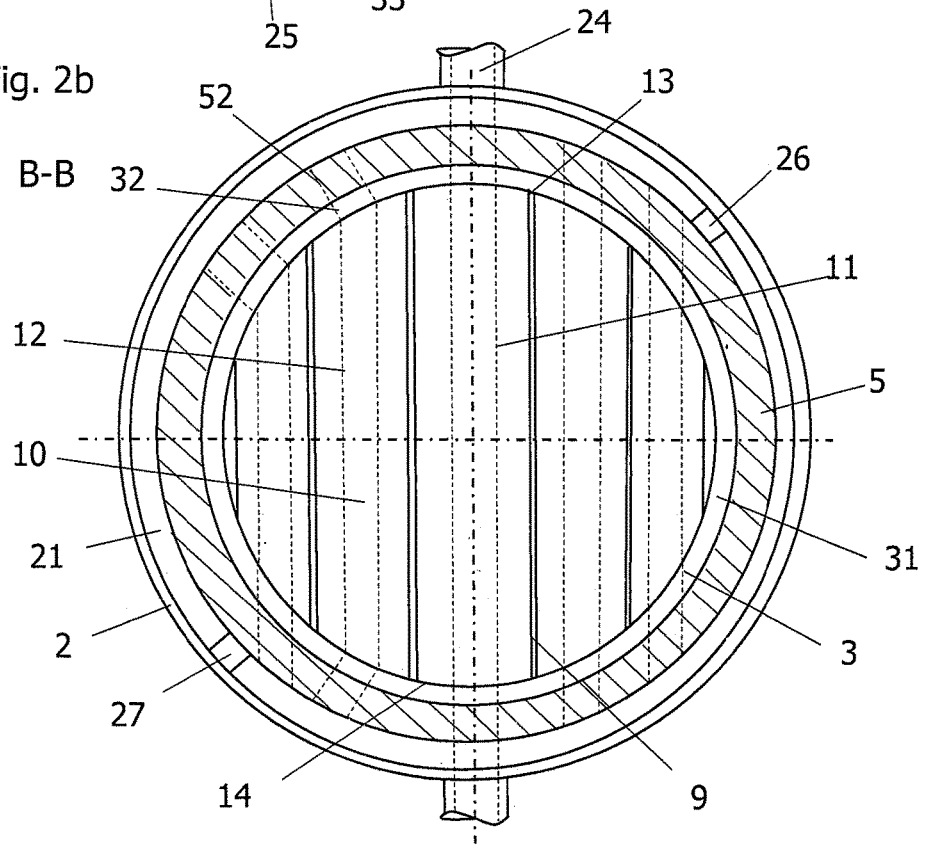

FIG. 2*b* shows a radial section through the static mixer 1 according to FIG. 2*a*. The radial section is not placed through the web element channel 11 in this embodiment, since its course would correspond to the course shown in FIG. 1*b*. The intermediate jacket element 5 is hatched, the hatching of the insert element 3 and of the jacket element 2 are omitted in order to keep the representation clear. Identical parts are designated the same in this FIG. 2*b* and no longer described, as far as the description has already been made in connection with FIG. 1*a*, 1*b* or FIG. 2*a*. FIG. 2*b* shows a web element 9 belonging to the group 6 and two web elements 10 belonging to the group 7. According to the present representation, the group 6 contains two further web elements with web element channels.

In the left-hand part of FIG. 2*b*, most of the insert jacket channels 32, 33 extend in a substantially radial direction, which is illustrated by dashed lines. Also, most intermediate jacket element channels 51, 52 extend in a substantially radial direction.

In the right-hand part of FIG. 2*b*, the insert jacket channels 32, 33 extend in the direction of the longitudinal axis of the web element, which is illustrated by dashed lines. Also, the intermediate jacket element channels 51, 52 extend in a direction substantially parallel to the longitudinal axis of the web element.

Figure 3A:
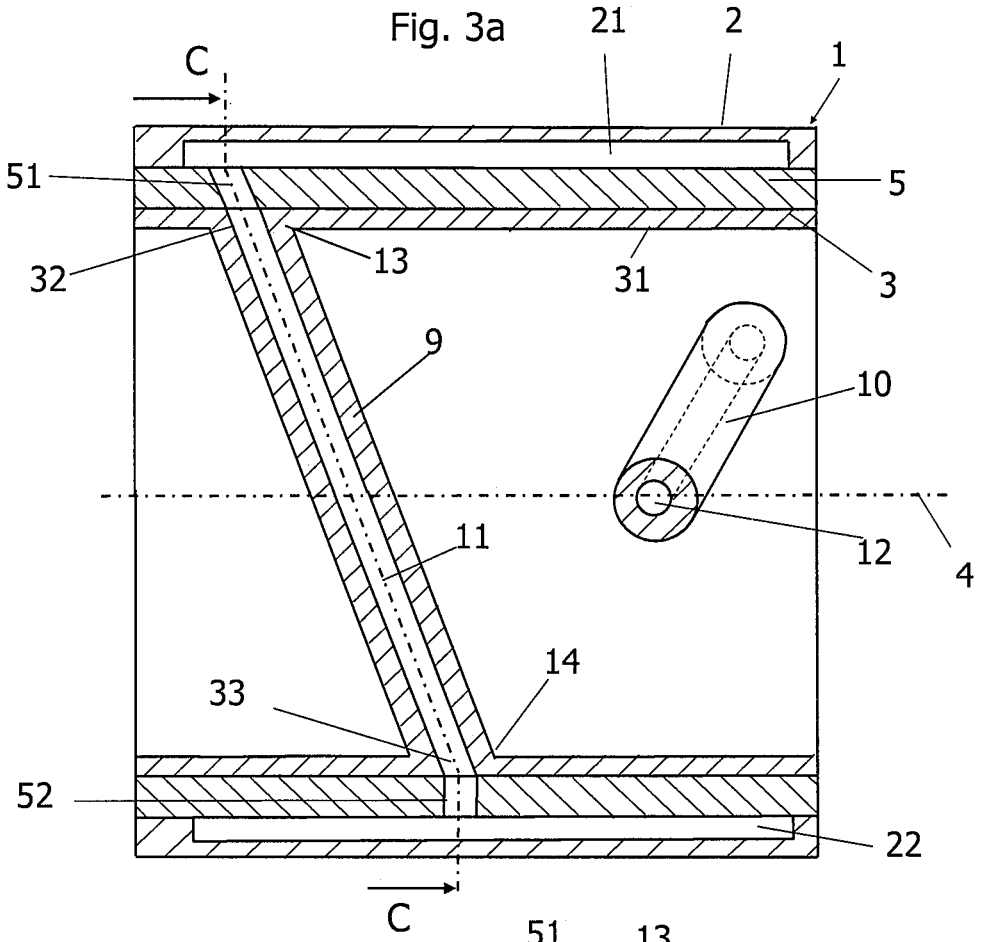
FIG. 3*b*: a radial section through the heat exchanger according to FIG. 3*a*, FIG. 4*a*: a longitudinal section through a heat exchanger according to a fourth embodiment.

FIG. 3*a* shows a longitudinal section through a heat exchanger 1 according to a third exemplary embodiment, with FIG. 3*a* showing two variants of the heat exchanger 1. The heat exchanger 1 for static mixing and heat exchange according to FIG. 3*a* contains a jacket element 2 and an insert element 3, the insert element 3 being arranged in the interior of the jacket element 2 in the operating state. The insert element 3 differs from the previous embodiments in that the web element channel 11 of the web element 9 is formed kink-free. The longitudinal axis of the web element channel 11 coincides with the longitudinal axis of the insert jacket channels 32, 33. The heat transfer fluid can thus flow through the insert element 3 without deflection. According to a first variant, the longitudinal axis of the intermediate jacket element channel 51 also coincides with the longitudinal axis of the web element 9. The intermediate jacket element channel 51 thus forms the continuation of the insert jacket channel 32.

According to a second variant, the longitudinal axis of the intermediate jacket element channel 52 extends in a substantially radial direction. Therefore, a kink is formed between the insert jacket channel 32 and the intermediate jacket element channel 52, which is shown on the lower side of FIG. 3*a*.

Figure 3B:
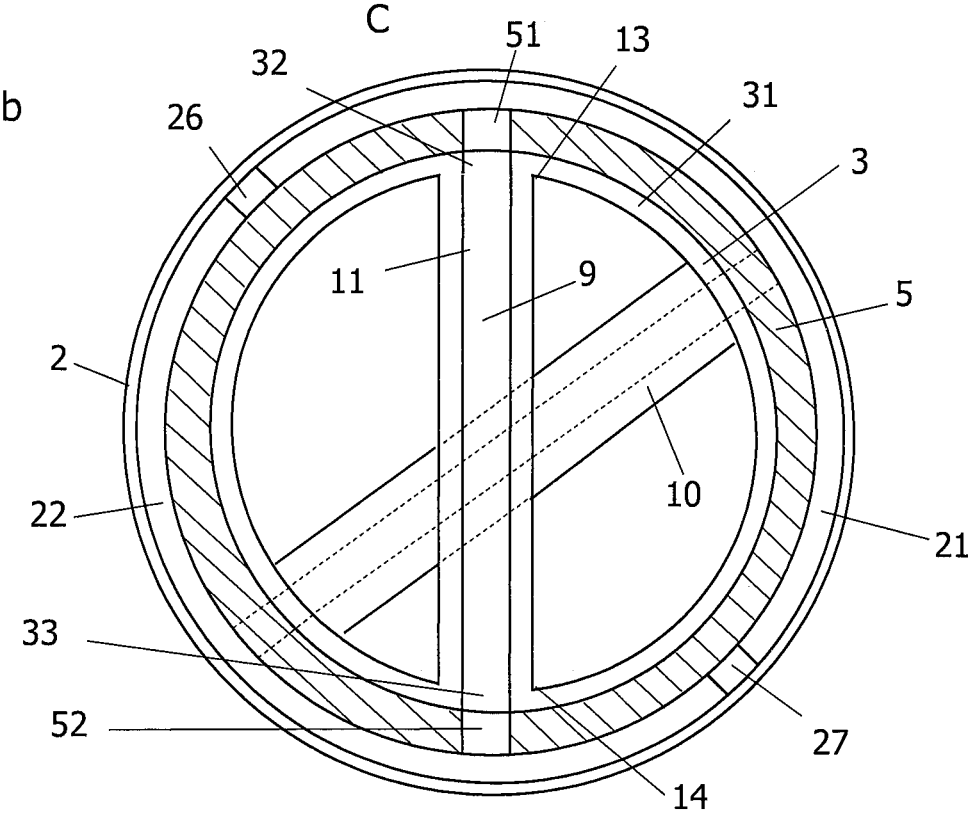

The web element 9 and the web element 10 are arranged according to this variant in an angle not equivalent to 90 degrees, what is shown in FIG. 3*b*.

FIG. 4*a* shows a longitudinal section through a heat exchanger 1 according to a fourth embodiment. The web elements 9, 10 of the insert element 3 are arranged substantially in the radial direction, that is, the longitudinal axis of the web elements 9, 10 extends at an angle of 90 degrees to the longitudinal axis 4. The web elements 9, 10 may have a circular or oval cross-section.

FIG. 4*b* shows a longitudinal section through a heat exchanger 1 according to a fifth embodiment, which differs from the heat exchanger 1 according to the embodiment shown in FIG. 4*a* in that at least one of the web elements 9, 10 has a rectangular cross-sectional area.

A first insert element 3 according to FIG. 4*a* or each of the previous exemplary embodiments can be combined with a second insert element according to FIG. 4*b* or each of the previous embodiments. The one or more jacket elements 2 and the one or more intermediate jacket elements 5 may be the same. They are arranged one behind the other along the longitudinal axis 4 to provide a heat exchanger of greater length and with improved efficiency.

The first jacket element 2 and/or the first insert element 3 may be rotated with respect to the second jacket element 2 and the second insert element 3 by an angle of 20 degrees to 90 degrees. The supply of heat transfer fluid to the mixing chamber via a first supply line, not shown, and its removal via a first discharge line, not shown. Because the second jacket element 2 and/or the second insert element 3 is twisted in its entirety by an angle of 20 degrees to 90 degrees with respect to the first jacket element 2, the second inlet and the second outlet can be rotated by an angle of 20 degrees to 90 degrees.

FIG. 4*c* shows a radial section through the heat exchanger according to FIG. 4*a* or FIG. 4*b*, wherein the radial section does not differ from the representation according to FIG. 1*b*, so that reference can be made to the description of FIG. 1*b*.

The web elements can be arranged with respect to each other at any angle. Web elements of any cross-sectional area can be combined with each other in an insert element 3. In particular, each web element 9 of a group 6 may differ from the other web elements of the same group. In particular, each web element 10 of one group 7 may differ from the other web elements of the same group. The web elements of group 6 may also differ from the web elements of group 7.

A plurality of similar or different web elements 9 can be arranged along the first group plane. A plurality of similar or different web elements 10 may be arranged along the second group plane. The angle which the illustrated section line of the first group plane in the drawing plane according to one of the FIGS. 1*a*, 2*a*, 3*a*, 4*a* encloses with the longitudinal axis 4, may differ from the angle which the illustrated section line of the second group plane in the plane of the drawing Includes longitudinal axis 4. The web widths of the web elements of the first group 6 may differ from one another and/or from the web widths of the web elements of the second group 7.

Adjacent groups may optionally have parallel group planes or may include different angles to the longitudinal axis 4.

According to another variant, not shown in the drawings, more than two groups may intersect and also be interconnected via common connecting elements. The connecting elements may for example comprise transverse webs. A web element may also consist of a plurality of web element sections. For example, adjacent web element sections can enclose an angle to one another. It would also be possible for the first web element section and the second web element section to be connected to one another via a curved section, wherein this variant is also not shown in the drawing.

The invention is not limited to the present embodiments. The web elements can differ in their number and in their dimensions. Furthermore, the number of web element channels in the web elements may differ depending on the required heat requirement for the heat transfer. Also, the angles of inclination that the groups include with the longitudinal axis may vary depending on the application. More than two insert elements can also be arranged in succession.

It will be apparent to those skilled in the art that many other modifications are possible in addition to the described embodiments without departing from the inventive concept. The object of the invention is thus not limited by the foregoing description and is determined by the scope of protection defined by the claims. The widest possible reading of the claims is decisive for the interpretation of the claims or the description. In particular, the terms "contain" or "include" are to be interpreted as referring to elements, components or steps in a non-exclusive sense, to indicate that the elements, components or steps may be present or used can be combined with other elements, components or steps that are not explicitly mentioned. If the claims refer to an element or component from a group which may consist of A, B, C, . . . N elements or components, that formulation should be interpreted as requiring only a single element of that group, not a combination of A and N, B and N or any other combination of two or more elements or components of this group.

The invention claimed is:

1. A heat exchanger comprising a jacket element and an insert element, wherein the insert element is arranged in an operating state inside the jacket element, wherein the insert element has a longitudinal axis wherein the insert element includes an insert jacket element and at least one web element, the web element having a first end and a second end, the first end and the second end of the web element being connected to the insert jacket element at different locations, the web element comprising a web element channel, the web element channel extending from the first end of the web element to the second end of the web element, wherein the insert jacket element includes an insert jacket channel which is fluid-conductively connected to one of a plurality of web element channels, wherein an intermediate jacket element is arranged between the insert jacket element and the jacket element, and wherein the insert jacket channel is fluidly connected to an intermediate jacket element channel.

2. The heat exchanger according to claim 1, wherein the insert jacket element has an average wall thickness which is smaller than a mean wall thickness of the intermediate jacket element.

3. The heat exchanger according to claim 1, wherein the insert jacket element and the intermediate jacket element are arranged at least partially adjacent to each other.

4. The heat exchanger according to claim 1, wherein the jacket element includes a jacket channel which is in fluid communication with the web element channel, wherein the jacket channel may contain a heat transfer fluid.

5. The heat exchanger according to claim 4, wherein the jacket channel includes a plurality of jacket element chambers.

6. The heat exchanger according to claim 1, wherein the web elements are connected to the insert jacket element by at least one of the following methods:

gluing, soldering, casting, an additive manufacturing process, welding, clamping, or shrink-fitting.

7. The heat exchanger according to claim 1, wherein the insert jacket element and the web elements are integrally formed.

8. The heat exchanger according to claim 1, wherein the insert element and the intermediate jacket element contain different materials.

9. The heat exchanger according to claim 1, wherein a wall thicknesses of the insert element and the intermediate jacket element together amount to at least 10 mm.

10. The heat exchanger according to claim 1, wherein the jacket channel includes a supply line for a heat transfer fluid and a discharge line for the heat transfer fluid or wherein each jacket element chambers contains either the supply line or the discharge line for the heat transfer fluid or wherein each of the supply lines or discharge lines is connected to at least one of each intermediate jacket element channels.

11. The heat exchanger according to claim 1, wherein a jacket element chamber is designed as a heat transfer fluid distributor, when the jacket element chamber contains a supply line or wherein a jacket element chamber is formed as a heat transfer fluid collector when the jacket element chamber contains a discharge line.

12. A heat exchanger comprising:

a hollow jacket element having a longitudinal axis and a channel for a flow of medium therethrough;

an insert element disposed concentrically within said hollow jacket element and longitudinally on said axis, said insert element including an insert jacket element and at least one web element having a first end and a second end, said first end and said second end being connected to said channel of said jacket element at different locations thereof, said at least one web element having a web element channel extending from said first end to said second end; and an intermediate jacket element is arranged concentrically between said insert jacket element and said jacket element, wherein the insert jacket element includes an insert jacket channel which is fluid-conductively connected to one of a plurality of web element channels, and wherein the insert jacket channel is fluidly connected to an intermediate jacket element channel.

13. A method for producing a heat exchanger, which comprises an insert element and a jacket element, wherein the insert element comprises at least one web element arranged in a non-zero angle with respect to a main flow direction and an insert jacket element fixedly connected to the web element, wherein the web element and the insert jacket element are manufactured by a method from the group consisting of gluing, soldering, casting, an additive manufacturing method, welding method, a clamping method or a shrink-fitting method, wherein the web element comprises a web element channel which is produced by the casting method together with the insert jacket element or produced in a further step by means of a drilling method or an erosion method, wherein the web element channel extends from a first end of the web element to a second end of the web element, wherein the insert element is positioned in the jacket element, wherein an intermediate jacket element is arranged between the insert element and the jacket element, which has a first intermediate jacket element channel and a second intermediate jacket element channel, the intermediate jacket element being positioned in the jacket element and the insert element being positioned in the intermediate jacket element such that a heat transfer fluid can flow through the jacket channel to the first intermediate jacket element channel into the web element channel and can flow through the web element channel and from the web element channel through the second intermediate jacket element channel into the jacket channel, wherein the insert jacket element includes an insert jacket channel which is fluid-conductively connected to one of a plurality of web element channels, and wherein the insert jacket channel is fluidly connected to an intermediate jacket element channel.

* * * * *